US009986858B1

(12) United States Patent
Sedano

(10) Patent No.: US 9,986,858 B1
(45) Date of Patent: Jun. 5, 2018

(54) CARRYING DEVICE AND METHOD OF USING THE SAME

(71) Applicant: Alex Sedano, Canyon Country, CA (US)

(72) Inventor: Alex Sedano, Canyon Country, CA (US)

( * ) Notice: Subject to any disclaimer, the term of this patent is extended or adjusted under 35 U.S.C. 154(b) by 0 days. days.

(21) Appl. No.: 15/668,566

(22) Filed: Aug. 3, 2017

(51) Int. Cl.
*A47G 19/08* (2006.01)

(52) U.S. Cl.
CPC ..... *A47G 19/08* (2013.01)

(58) Field of Classification Search
CPC ..... A47J 47/16; A47B 81/04; A47G 19/08
See application file for complete search history.

(56) References Cited

U.S. PATENT DOCUMENTS

2007/0295675 A1* 12/2007 Anker ..... A47J 47/16 211/31
2012/0031860 A1* 2/2012 Goode ..... A47F 5/02 211/41.2
2014/0102998 A1* 4/2014 Waksul ..... A47B 81/04 211/41.2
2015/0014495 A1* 1/2015 Bausman ..... A47J 47/16 248/176.2

* cited by examiner

*Primary Examiner* — Stephen A Vu
(74) *Attorney, Agent, or Firm* — Omid Legal Group; Omid E. Khalifeh

(57) ABSTRACT

A carrying device and method of using the same is characterized by, in some embodiments, a central section having at least two side pieces, a central crossbar, a middle crossbar, at least one handle, at least one front post, a first platform, and a second platform, and a rear section attached to the center section wherein the rear section has at least one step-shaped unit. In some embodiments, the first platform and the second platform may swivel to accommodate a user who wishes to place the carrying device on either the user's right shoulder or left shoulder. To use the device, in some embodiments, a user may place one or more food service items on at least one of the carrying surfaces provided by the center section of the device, step-shaped unit(s), first platform, and/or second platform.

20 Claims, 5 Drawing Sheets

CARRYING DEVICE AND METHOD OF USING THE SAME

GOVERNMENT CONTRACT

Not applicable.

CROSS-REFERENCE TO RELATED APPLICATIONS

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material which is subject to copyright protection. This patent document may show and/or describe matter which is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to shoulder-mounted equipment, and more particularly to a shoulder-mounted device for carrying food-service items.

BACKGROUND

Many restaurants rely on waiters (or "servers" at times herein) to deliver food to guests promptly and safely. In such scenarios, waiters often hand-carry each dish to the table and serve the dishes to the appropriate guest. This time-honored tradition is gratifying to guests and a standard in the industry. However, even the most skilled waiter can only carry a limited number of dishes at any one time. Several reasons for this limitation exist. For example, the size of the waiter's arms and hands may limit the size of dishes that the waiter can manipulate, lift or steady against the waiter's person. Also, the restaurant's dining room could be filled with obstacles such as chairs, footstools, persons, children, or pets and, therefore, a waiter must have the ability to move the waiter's arms as needed to maintain his or her balance. Furthermore, the restaurant may proscribe certain carrying practices so as to prohibit the waiter from overburdening her or himself in the performance of her or his duties, for liability or guest experience purposes.

For the above reasons, and others, a device is needed that makes it easy for a waiter to carry a variety of food and beverage service items such as plates and bowls of all sizes, serving platters, ice buckets for champagne, sizzling hot skillets, covered dishes, and so forth (collectively, "food service items"). Preferably, in at least one embodiment, such a device may be shoulder-mounted for stability and ease of use purposes. Such a device could also be used by any person wishing to carry any item, in addition to or instead of food service items.

Some attempts at meeting this need have been made. For example, U.S. Pat. No. 953,007, incorporated by reference herein in its entirety, discloses a hand-held device for waiters that provides for a series of levels upon which a waiter may stack multiple plates and distribute them with the waiter's free hand. While this disclosure does provide for a vertically stacked food service item-carrying device, its hand-held design would weary the waiter unnecessarily.

Another attempt can be seen with respect to U.S. Pat. No. 7,000,799, incorporated by reference in its entirety herein, generally discloses a hand-held serving tray that servers could use to deliver food and beverages to tables. While this disclosure does provide for a body-mounted solution, via a thumb-hole and forearm-covering flat surface, it fails to provide for a tiered structure capable of supporting multiple large plates at once. Additionally, its thumb hole makes it necessary to provide servers with two such items: one for right-handed servers and one for left-handed servers.

Another attempt to meet this need can be found in the disclosure of U.S. Pat. No. 7,520,550, incorporated by reference in its entirety herein, which generally discloses a tiered plate-carrying device that mounts on a user's arm. While this disclosure does enable a user to deliver multiple large plates in one trip, it also suffers from a design that relies on a user's arm strength to carry the potentially heavy plates, rather than the shoulder's larger muscle groups.

Still, none of these in existence comprise beneficial characteristics described in the following disclosure. Thus, there remains a need for a new shoulder-mounted device for carrying food-service items.

SUMMARY

The present disclosure is directed to a shoulder-mounted device that may enable a user to carry food-service items, in addition to other properties.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

In some embodiments, the present invention may comprise a carrying device, comprising, generally, a center section, a rear section attached to the center section wherein the rear section has at least one step-shaped unit attached to the center section, at least one handle, at least one front post, a first swiveling platform, a second swiveling platform.

In some embodiments, the center section may provide for two side pieces, a central crossbar and a middle crossbar. Each side piece may have a middle portion, a first end, and a second end. The central crossbar and the middle crossbar may each have two ends. The central crossbar's two ends may be attached to the first ends of the side pieces. The middle crossbar's two ends may be attached to the middle portions of the side pieces. Thus, the "front" of the center section may be filled by a central crossbar that connects the two side pieces, and a middle crossbar may join the "middle" of the center section, but the second ends of the side pieces may not be joined directly to each other.

In some embodiments, it is contemplated that the two second ends of the side pieces may be joined by a third or rear crossbar. Furthermore, in embodiments where a third or rear crossbar joins the two second ends of the side pieces, the middle crossbar may run from central crossbar to rear or third crossbar, rather than from side piece to side piece. In some embodiments, the middle crossbar may be shaped as a cross having a midpoint and four ends, wherein an end is joined to each side piece, the central crossbar, and the rear or third crossbar. In some embodiments, one or more elements may fill in the open space between the side pieces, between the central crossbar and the middle crossbar, between the middle crossbar and the third or rear crossbar, or any empty space left by any arrangement of center section pieces or portions.

In some embodiments, the rear section may comprise or provide for at least one "step," meaning an element shaped like a step of a staircase, and wherein if more than one step is provided by the present invention, the step-shaped units are intended to be connected, and wherein the connected step-shaped units resemble a staircase in profile. Each step may comprise two vertical elements, two horizontal elements, two connector elements, a step crossbar, and a protrusion. Each vertical element may have a first end and a second end. Each horizontal element may have a first end and a second end. Each connector element may have a first end, a second end, an inside side and an outside side. The step crossbar may have two ends.

In some embodiments, each connector element's first end may be connected to a vertical element's first end, and each connector element's second end may be connected to a horizontal element's first end. Each end of the step crossbar may be connected to the inside side of a connector element. In some embodiments, the connector element is configured to position the horizontal element at a perpendicular position relative to the vertical position.

If more than one step is provided, it is contemplated that each horizontal element's second end may be connected to the second end of the corresponding second step vertical element via additional connector elements. In some embodiments, the additional connector elements may position the horizontal element of the first step in a perpendicular configuration relative to the vertical element of the second step.

In some embodiments, the protrusion may extend outward from the step crossbar. In some embodiments, the protrusion may be shaped like a capital "T". In other embodiments, the protrusion may be shaped as a square, an oval, or any other shape. In some embodiments, the protrusion may be configured to retain the edge of at least one plate. As such, in some embodiments, the protrusion may be coplanar with the horizontal portion and perpendicular to the vertical portion.

In some embodiments, the present invention may provide that the vertical element extends beyond the connection point with the corresponding horizontal element, thereby providing an edge or barrier above the plane of the horizontal element. Such barrier could be helpful to the user in securing an object on the carrying area created by the combination of horizontal elements and step crossbar(s).

In some embodiments, the present invention may provide for a handle portion that may connect to the middle crossbar's bottom side and extend downward. In some embodiments, the handle may be configured to connect to the middle crossbar at a perpendicular angle.

The present invention may also provide for a front post that may connect to the central crossbar's bottom side and extend downward. In some embodiments, the front post may be configured to connect to the central crossbar at a perpendicular angle.

The present invention may also provide for a first platform. In some embodiments, the first platform may connect to the front post second end, and may be configured to swivel around the front post second end ("swivelly connected"). In some embodiments, the first platform may be configured to be in a perpendicular orientation to the front post. In some embodiments, the first platform may be configured as a single element that may be configured to support one or more food service items. In some embodiments, the first platform may comprise two first platform pieces, wherein each first platform piece has a first end and a second end, and wherein the first end of the first platform piece may be connected to the second end of the second first platform piece. In some embodiments, the first platform may comprise a plurality of first platform pieces, wherein each first platform piece has a first end and a second end, and wherein first end of each first platform piece may be connected to the second end of another first platform piece.

The present invention may also provide for a second platform that may be connected to the handle's second end, wherein the second platform may be configured to swivel around the handle second end. In some embodiments, the second platform may be configured to be in a perpendicular orientation to the handle. In some embodiments, the second platform may be configured as a single element that may be configured to support one or more food service items. In some embodiments, the second platform may comprise two second platform pieces, wherein each second platform piece has a first end and a second end, and wherein the first end of the first second platform piece may be connected to the second end of the second platform piece. In some embodiments, the second platform may comprise a plurality of second platform pieces, wherein each second platform piece has a first end and a second end, and wherein first end of each second platform piece may be connected to the second end of another second platform piece.

In some embodiments, the present invention may further comprise at least one stand element, wherein the at least one stand element has a first end and a second end, and wherein the at least one stand first end is connected to at least one portion of the underside of the second platform.

In some embodiments, the handle may be longer than the front post. In some embodiments, the front post may be longer than the handle.

The present invention may also comprise one or more connector elements, which may be curved, T-shaped, cylindrical, ring-shaped, macaroni-shaped, or any other shape. It is contemplated that in some embodiments, the present invention may provide for one or more curved elements to be positioned as a horizontally-oriented curved element. It is also contemplated that in some embodiments, the present invention may provide for one or more curved elements to be positioned as a vertically-oriented curved element. The horizontally-oriented curved element and/or the vertically-oriented curved element(s) may enable one or more elements of the present invention to be oriented in a horizontal or vertical, respectively, orientation to one another. One or more T-shaped connector elements may enable one or more elements of the present invention to be oriented in an orthogonal orientation to one another. In some embodiments, the present invention may provide for one or more cylindrical connector elements and/or ring-shaped connector elements that may enable one or more elements of the present invention to be oriented in a parallel orientation to one another.

In some embodiments, the above-described connector elements may not function or be configured to connect one or more elements, but may instead rest upon or be positioned over one or more elements.

The present invention may also provide for a method of using a carrying device, wherein the method generally comprises providing a center section; providing a first side piece having a first end, a second end, and a middle portion;

a second side piece having a first end, a second end, and a middle portion; a central crossbar having a top side, a bottom side, a first end, and a second end, wherein the central crossbar first end is connected to the first side piece first end and the central crossbar second end is connected to the second side piece first end; a middle crossbar having a top side, a bottom side, a first end, and a second end, wherein the middle crossbar first end is connected to the first side piece middle portion and the middle crossbar second end is connected to the second side piece middle portion; a rear section having at least one step, each step comprising a first vertical element having a first end and a second end, a second vertical element having a first end and a second end, a first horizontal element having a first end and a second end, a second horizontal element having a first end and a second end, a first connector element having a first end, a second end, an inside side and an outside side, wherein the first connector element first end is connected to the first vertical element first end and the first connector element second end is connected to the first horizontal element first end, a second connector element having a first end, a second end, an inside side and an outside side, wherein the second connector element first end is connected to the second vertical element first end and the second connector element second end is connected to the second horizontal element first end, a step crossbar having a middle portion, a first end, and a second end, wherein the step crossbar first end is connected to the first connector element inside side and the step crossbar second end is connected to the second connector element inside side.

Additionally, the method may comprise providing at least one protrusion, wherein the at least one protrusion extends from the step crossbar middle portion; a handle having a first end and a second end, wherein the handle first end is connected to the middle crossbar bottom side; a front post having a first end and a second end, wherein the front post first end is connected to the central crossbar bottom side; a first platform connected to the front post second end, wherein the first platform is configured to swivel around the front post second end; and a second platform connected to the handle second end, wherein the second platform is configured to swivel around the handle second end. Next, the method may further comprise placing at least one object on one or more of the at least one step, the center section, the first platform, and the second platform and carrying the object to a destination.

In some embodiments, the present invention may be comprised of several portions. By way of illustration and not limitation, in such embodiments the present invention may comprise at least one center member, wherein the center member has at least one first vertical portion, at least one first horizontal portion, and at least one first angled portion having a first inside-side and a first outside-side. In some embodiments, the at least one first horizontal portion may be configured to extend along a plane, such as a horizontal or near-horizontal plane. In some embodiments, the at least one first angled portion may connect the at least one first vertical portion to the at least one first horizontal portion.

Furthermore, in such embodiments, the present invention may also provide for at least one second center member having at least one second vertical portion, at least one second horizontal portion, and at least one second angled portion having a second inside-side and a second outside-side. In some embodiments, the at least one second horizontal portion may be configured to extend along a plane, such as a horizontal or near-horizontal plane. In some embodiments, the at least one second angled portion may connect the at least one second vertical portion to the at least one second horizontal portion.

Additionally, in such embodiments, the present invention may provide for at least one connecting portion, wherein the connecting portion may connect the first inside-side of the at least one first angled portion to the second inside-side of the at least one second angled portion.

Some such embodiments may further comprise at least one protrusion that may extend from the at least one connecting portion. In some embodiments, the at least one protrusion may extend in the same plane as the horizontal portion.

The present invention, in some such embodiments, may further comprise at least one handle element connected to the at least one connecting portion and at least one platform connected to the at least one handle element. In some embodiments, the at least one platform may be swivelly connected to the at least one handle element.

One or more of the above-disclosed embodiments, in addition to certain alternatives, are provided in further detail below with reference to the attached figures. The disclosed subject matter is not, however, limited to any particular embodiment disclosed.

Figure 1:
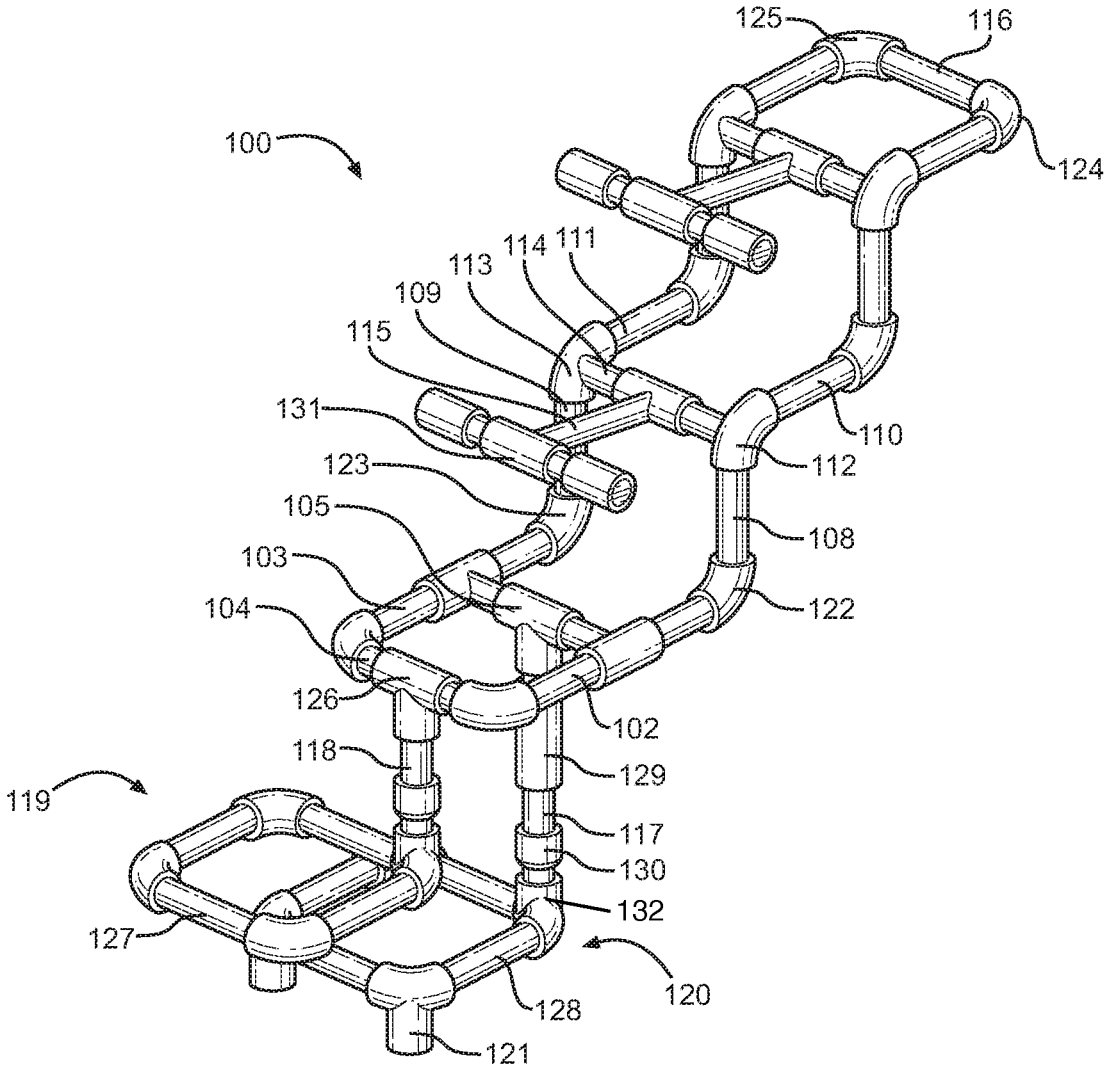
FIG. 1 shows a front perspective view of a carrying device in accordance with an embodiment of the invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

With reference to FIG. 1, a front perspective view of a carrying device in accordance with an embodiment of the invention may be seen. In the embodiment depicted, a viewer may perceive carrying device 100, first side piece 102, second side piece 103, central crossbar 104, middle crossbar 105, first vertical element 108, second vertical element 109, first horizontal element 110, second horizontal element 111, first connector element 112, second connector element 113, step crossbar 114, protrusion 115, rear crossbar 116, handle 117, front post 118, first platform 119, second platform 120, foot piece 121, first vertically-oriented curved element 122, second vertically-oriented curved element 123, first horizontally-oriented curved element 124, second horizontally-oriented curved element 125, T-shaped element 126, first platform piece 127, second platform piece 128, cylindrical element 129, ring-shaped element 130, protrusion crossbar 131, and curved T-shaped element 132.

As can be seen in FIG. 1, in some embodiments, the present invention may provide for more than one first connector element 112, second connector element 113, first vertically-oriented curved element 122, second vertically-oriented curved element 123, first horizontally-oriented curved element 124, second horizontally-oriented curved element 125, T-shaped element 126, cylindrical element 129, foot piece 121, ring-shaped element 130, or curved T-shaped element 132.

Additionally, it is contemplated that the dimensions of all elements of the present invention, such as but not limited to any element's diameter or length, may vary considerably. It is therefore contemplated that the present invention's shape, including any sections, portions of sections, or individual elements, may differ from the embodiment generally disclosed in FIG. 1, Continuing with FIG. 1, the present invention may comprise a central section (not numbered in FIG. 1) that may be comprised of first side piece 102, second side piece 103, central crossbar 104, and middle crossbar 105. In some embodiments, the central section may further comprise a T-shaped element 126 that may be positioned either on top of or in a connecting configuration to middle crossbar 105. In some embodiments, the central section may further comprise a handle 117 that in some embodiments may be configured to be in an orthogonal orientation to middle crossbar 105 via either a connection to a T-shaped element 126 or by direct connection to middle crossbar 105.

In some embodiments, the central section may further comprise a T-shaped element 126 that may be positioned either on top of or in a connecting configuration to central crossbar 104. In some embodiments, the central section may further comprise a front post 118 that in some embodiments may be configured to be in an orthogonal orientation to central crossbar 104 via either a connection to T-shaped element 126 or by direct connection to central crossbar 104.

Remaining with FIG. 1, in some embodiments, the central section may further comprise a first platform 119, which may be connected to handle 117 via curved T-shaped element 132. In some embodiments, first platform 119 may be configured to swivel around handle 117 via curved T-shaped element 132. In some embodiments, first platform 119 may comprise at least one first platform piece 127. In FIG. 1, first platform 119 is depicted as comprising four first platform pieces 127 configured in an approximately square orientation, and wherein at three first platform pieces 127 are joined by two foot piece(s) 121. As discussed above, as any element may be longer or shorter, first platform 119 may be shaped as a square, rectangle, oval, triangle, or any shape.

In some embodiments, the central section may further comprise a second platform 120, which may be connected to front post 118 via curved T-shaped element 132. In some embodiments, second platform 120 may be configured to swivel around front post 118 via curved T-shaped element 132. In some embodiments, second platform 120 may comprise at least one second platform piece 128. In FIG. 1, second platform 120 is depicted as comprising four second platform pieces 128 configured in an approximately square orientation. Additionally, again as discussed above, because any element may be longer or shorter, second platform 120 may be shaped as a square, rectangle, oval, triangle, or any shape.

The present invention may comprise a rear section that may be comprised of first vertical element 108, second vertical element 109, first horizontal element 110, second horizontal element 111, first connector element 112, second connector element 113, step crossbar 114, protrusion 115, and in some embodiments protrusion crossbar 131. The present invention may further comprise one or more additional rear sections that may be connected to each other by means of first vertically-oriented curved element 122 and second vertically-oriented curved element 123, that in some embodiments may connect the first horizontal element 110 and the second horizontal element 111 of the first rear section with the first vertical element 108 and the second vertical element 109 of the second rear section, respectively. Additionally, in some embodiments, the first horizontal element 110 and the second horizontal element 111 of the last rear section may be connected to a first horizontally-oriented curved element 124 and a second horizontally-oriented curved element 125, which may themselves be connected to either end of a rear crossbar 116, as can be seen in FIG. 1.

Figure 2:
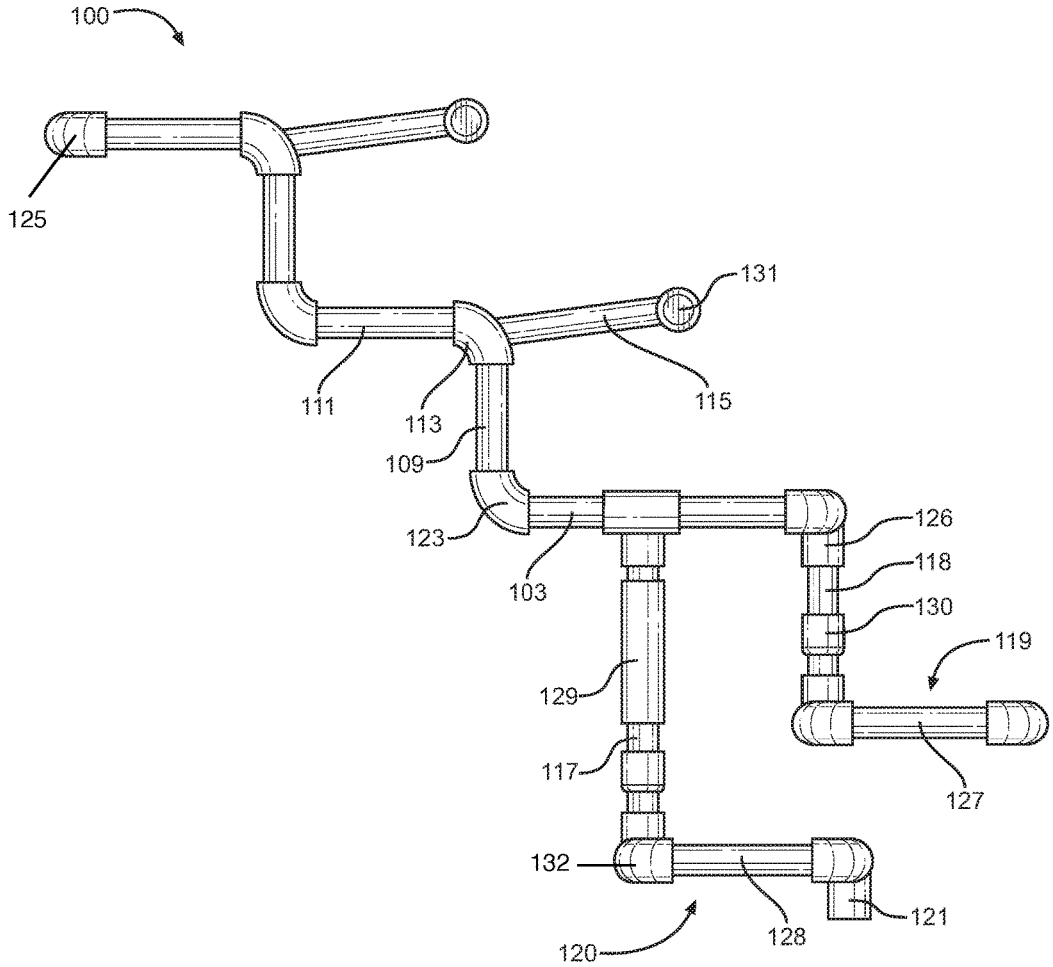
FIG. 2 shows a right side elevational view of a carrying device in accordance with an embodiment of the invention.

Turning attention to FIG. 2, a viewer may perceive an elevational view of a carrying device in accordance with an embodiment of the invention. More specifically, a viewer may perceive carrying device 100, second side piece 103, second vertical element 109, second horizontal element 111, second connector element 113, protrusion 115, handle 117, front post 118, first platform 119, second platform 120, foot piece 121, second vertically-oriented curved element 123, second horizontally-oriented curved element 125, T-shaped element 126, first platform piece 127, second platform piece 128, cylindrical element 129, ring-shaped element 130, protrusion crossbar 131, and curved T-shaped element 132.

Remaining with FIG. 2, as any element of the present invention may, in embodiments, be of longer, shorter, wider or thinner dimensions as discussed above, elements such as by way of illustration and not limitation protrusion 115, handle 117, front post 118, first platform 119, or second platform 120 may be longer or shorter than as may be perceived in the embodiment generally disclosed in FIG. 2.

Figure 3:
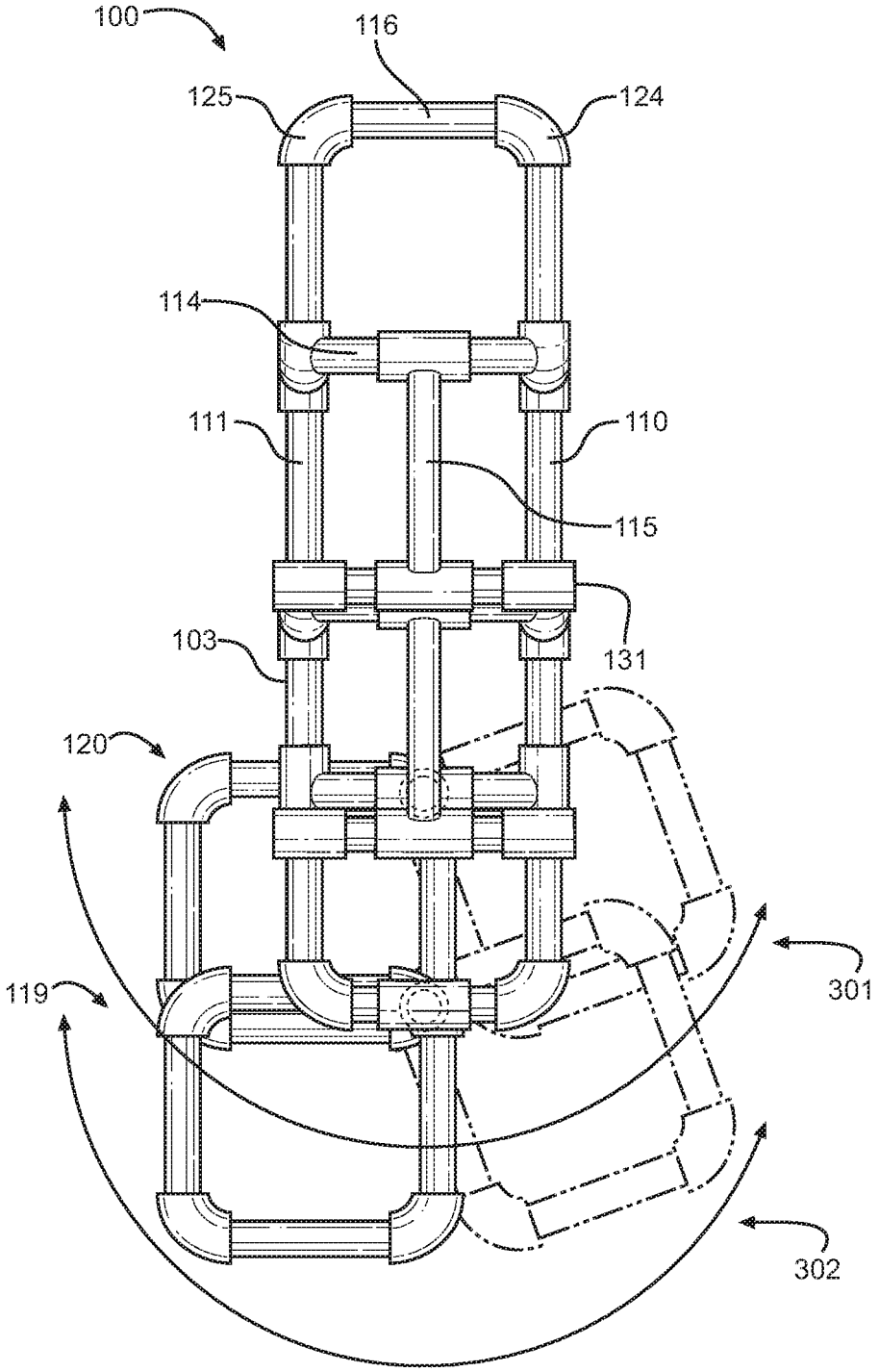
FIG. 3 shows a top plan view of a carrying device in accordance with an embodiment of the invention.

With respect to FIG. 3, a top plan view of a carrying device in accordance with an embodiment of the invention is shown. In the embodiment depicted, a viewer may perceive first platform rotational motion 301 and second platform rotational motion 302 may be perceived, along with carrying device 100, second side piece 103, first horizontal element 110, second horizontal element 111, step crossbar 114, protrusion 115, rear crossbar 116, first platform 119, second platform 120, first horizontally-oriented curved element 124, second horizontally-oriented curved element 125, and protrusion crossbar 131.

As FIG. 3 generally discloses, the range of first platform rotational motion 301 and second platform rotational motion 302 may, in some embodiments, extend entirely from one side of carrying device 100 to the other side of carrying device 100. In some embodiments, the present invention may provide that the range of first platform rotational motion 301 and second platform rotational motion 302 may be limited by one or more stopping elements of the present invention (not pictured). Additionally, in some embodiments, the present invention may provide for one or more retaining elements (not pictured) that, once first platform 119 and/or second platform 120 have reached a certain position, retain first platform 119 and/or second platform 120 in that position. In some embodiments, the retaining elements may be configured to be activated or deactivated by an action of a user, such as by way of illustration and not limitation, if user moves first platform 119 and/or second platform 120 or manipulates a lever or switch (neither pictured) that either engages or disengages the retaining element(s).

Figure 4:
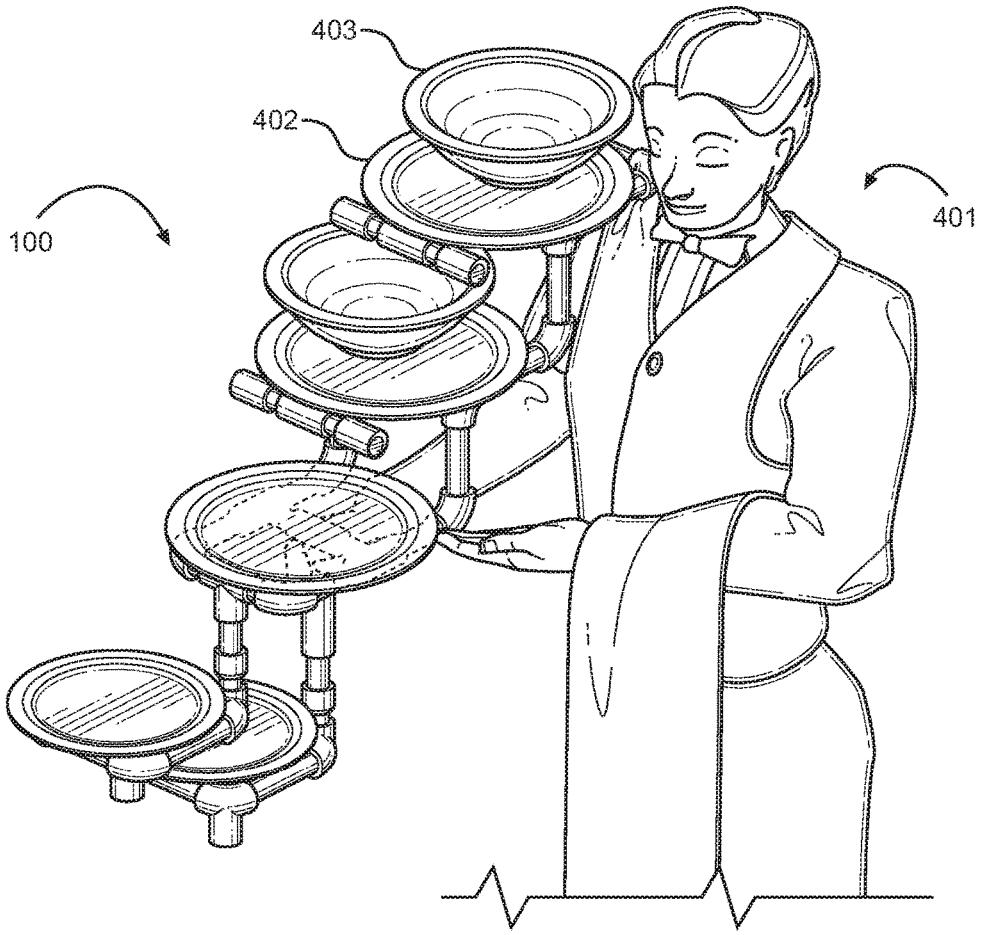
FIG. 4 shows a perspective view of a carrying device in accordance with an embodiment of the invention.

Turning attention to FIG. 4, a perspective view of a carrying device in accordance with an embodiment of the invention is shown. In the embodiment depicted, a viewer may perceive carrying device 100, as well as a user 401 carrying bowl 403 and plate 402. In the embodiment depicted in FIG. 4, user 401 carries a carrying device 100 that is fully loaded with more than one bowl 403 or plate 402. It is contemplated that any combination of objects may be carried by the present invention, including objects that sink into or otherwise break the plane of any level or section of the present invention, such as by way of illustration and not limitation, a bowl 403 that rests within a platform. Additionally, as the elements of the present invention may be larger or smaller, a user 401 could use an alternate embodiment of carrying device 100 that provided for circular platforms or sections, to carry one or more pizzas.

Figure 5A:
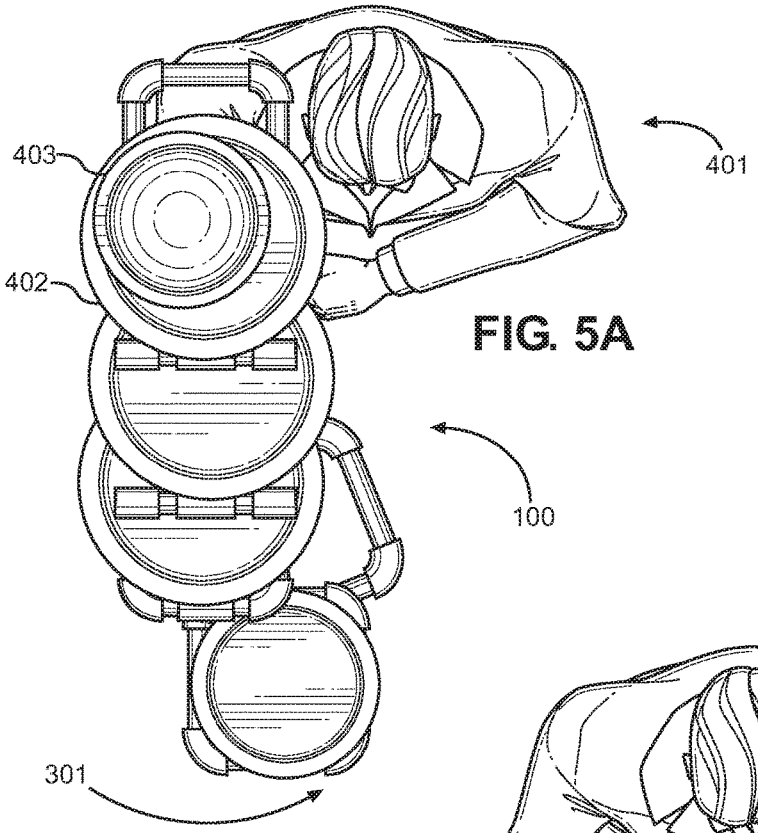
FIGS. 5A and 5B illustrate a method of using a carrying device in accordance with an embodiment of the invention.
Figure 5B:
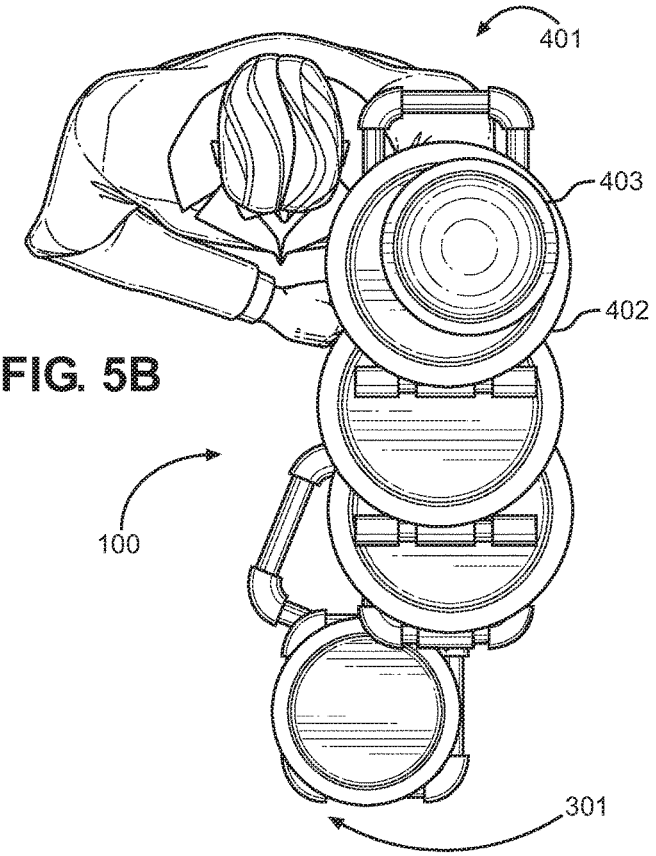

FIGS. 5A and 5B illustrate a method of using a carrying device in accordance with an embodiment of the invention. In FIG. 5A, a viewer may perceive a method of use wherein a user 401 may use carrying device 100 to carry bowl 403 and plate 402. Additionally, in the embodiment depicted, a user may perceive that user 401 may utilize first platform rotational motion 301 to align first platform 119 into a position enabling user 401 to hold carrying device 401 with the right arm and right shoulder of user 401, while enabling a relatively unencumbered range of motion for the left arm of user 401.

By contrast, FIG. 5B discloses a method of use wherein a user 401 may use carrying device 100 to carry bowl 403 and plate 402, wherein user 401 may utilize first platform rotational motion 301 to align first platform 119 into a position enabling user 401 to hold carrying device 401 with the left arm and left shoulder of user 401, while enabling a relatively unencumbered range of motion for the right arm of user 401.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. Accordingly, it is intended that the invention not be limited, except as by the appended claim(s).

The teachings disclosed herein may be applied to other systems, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the present invention with which that terminology is associated. In general, the terms used in the following claims should not be constructed to limit the present invention to the specific embodiments disclosed in the specification unless the above description section explicitly define such terms. Accordingly, the actual scope encompasses not only the disclosed embodiments, but also all equivalent ways of practicing or implementing the disclosed present invention. The above description of embodiments of the present invention is not intended to be exhaustive or limited to the precise form disclosed above or to a particular field of usage.

While specific embodiments of, and examples for, the present invention are described above for illustrative purposes, various equivalent modifications are possible for which those skilled in the relevant art will recognize.

While certain aspects of the present invention are presented below in particular claim forms, various aspects of the present invention are contemplated in any number of claim forms. Thus, the inventor reserves the right to add additional claims after filing the application to pursue such additional claim forms for other aspects of the present invention.

What is claimed is:

1. A carrying device, comprising:

at least one center member having:

a) at least one first vertical portion, at least one first horizontal portion, and at least one first angled portion having a first inside-side and a first outside-side, wherein the at least one first horizontal portion is configured to extend along a first plane, and wherein the at least one first angled portion is configured to connect the at least one first vertical portion and the at least one first horizontal portion;

b) at least one second center member having at least one second vertical portion, at least one second horizontal portion, and at least one second angled portion having a second inside-side and a second outside-side, wherein the at least one second horizontal portion is configured to extend along a second plane, and wherein the at least one second angled portion is configured to connect the at least one second vertical portion and the at least one second horizontal portion; and c) at least one connecting portion, wherein the connecting portion is configured to connect the first inside-side of the at least one first angled portion to the second inside-side of the at least one second angled portion;

at least one protrusion extending from the at least one connecting portion, wherein the at least one protrusion extends parallel to either of the first and second planes;

at least one handle element connected to the at least one connecting portion; and at least one platform connected to the at least one handle element.

2. The carrying device of claim 1, wherein the at least one platform is swivelly connected to the at least one handle element.

3. A carrying device, comprising:

a central element, comprising:

a) a first side piece having a first end, a second end, and a middle portion;

b) a second side piece having a first end, a second end, and a middle portion;

c) a central crossbar having a top side, a bottom side, a first end, and a second end, wherein the central crossbar first end is connected to the first side piece first end and the central crossbar second end is connected to the second side piece first end; and d) a middle crossbar having a top side, a bottom side, a first end, and a second end, wherein the middle crossbar first end is connected to the first side piece middle portion and the middle crossbar second end is connected to the second side piece middle portion;

a rear element having at least one step, each step comprising:

a) a first vertical element having a first end and a second end;

b) a second vertical element having a first end and a second end;

c) a first horizontal element having a first end and a second end;

d) a second horizontal element having a first end and a second end;

e) a first connector element having a first end, a second end, an inside side and an outside side, wherein the first connector element first end is connected to the first vertical element first end and the first connector element second end is connected to the first horizontal element first end;

f) a second connector element having a first end, a second end, an inside side and an outside side, wherein the second connector element first end is connected to the second vertical element first end and the second connector element second end is connected to the second horizontal element first end;

g) a step crossbar having a middle portion, a first end, and a second end, wherein the step crossbar first end is connected to the first angle inside side and the step crossbar second end is connected to the second angle inside side; and h) at least one protrusion, wherein the at least one protrusion extends from the step crossbar middle portion;

a handle having a first end and a second end, wherein the handle first end is connected to the middle crossbar bottom side;

a front post having a first end and a second end, wherein the front post first end is connected to the central crossbar bottom side; and a first platform connected to the front post second end, wherein the first platform is configured to swivel around the front post second end.

4. The device of claim 3, further comprising a second platform connected to the handle second end, wherein the second platform is configured to swivel around the handle second end.

5. The device of claim 3, wherein the first platform has a two first platform pieces, wherein each first platform piece has a first end and a second end, and wherein the first end of the first platform piece is connected to the first end of the second first platform piece.

6. The device of claim 3, wherein the first platform comprises a plurality of platform pieces, wherein each of the platform pieces comprising the first platform has a first end and a second end, and wherein the first end of each of the platform pieces comprising the first platform is connected to the second end of another of the platform pieces comprising the first platform.

7. The device of claim 3, further comprising two or more steps, wherein the first vertical element second end of the first step is connected to the first horizontal element second end of the second step, and the second vertical element second end of the first step is connected to the second horizontal element second end of the second step.

8. The device of claim 3, wherein the protrusion is T-shaped.

9. The device of claim 3, wherein the protrusion extends parallel to the first horizontal element and the second horizontal element.

10. The device of claim 3, wherein the rear element has two steps.

11. The device of claim 3, wherein the handle is longer than the front post.

12. The device of claim 3, wherein the front post is longer than the handle.

13. The device of claim 3, wherein each first horizontal element is configured to be at a perpendicular position relative to each first vertical element and each second horizontal element is configured to be at a perpendicular position relative to each second vertical element.

14. The device of claim 3, wherein the handle is configured to be at a perpendicular position relative to the middle crossbar.

15. The device of claim 3, wherein the front post first end is configured to be at a perpendicular position relative to the central crossbar.

16. The device of claim 3, wherein the first platform is configured to be at a perpendicular position relative to the front post.

17. The device of claim 4, wherein the second platform is configured to be at a perpendicular position relative to the handle.

18. The device of claim 4, wherein the second platform comprises a plurality of platform pieces, wherein each of the platform pieces comprising the second platform has a first end and a second end, and wherein the first end of each of the platform pieces comprising the second platform is connected to the first end of another of the platform pieces comprising the second platform.

19. The device of claim 4, wherein the second platform has a plurality of second platform pieces, wherein each second platform piece has a first end and a second end, and wherein the first end of each second platform piece is connected to the second end of another second platform piece.

20. The device of claim 4, further comprising at least one stand element, wherein the at least one stand element has a first end and a second end, and wherein the at least one stand first end is connected to at least one portion of the underside of the second platform.

* * * * *